US009308728B2

(12) United States Patent
Robinson et al.

(10) Patent No.: US 9,308,728 B2
(45) Date of Patent: Apr. 12, 2016

(54) METHOD OF MAKING INKJET PRINT HEADS HAVING INKJET CHAMBERS AND ORIFICES FORMED IN A WAFER AND RELATED DEVICES

(71) Applicant: STMICROELECTRONICS, INC., Coppell, TX (US)

(72) Inventors: Murray J. Robinson, Corinth, TX (US); Kenneth J. Stewart, Coppell, TX (US)

(73) Assignee: STMICROELECTRONICS, INC., Coppell, TX (US)

( * ) Notice: Subject to any disclaimer, the term of this patent is extended or adjusted under 35 U.S.C. 154(b) by 0 days.

(21) Appl. No.: 13/906,455

(22) Filed: May 31, 2013

(65) Prior Publication Data

US 2014/0354735 A1 Dec. 4, 2014

(51) Int. Cl.

| | |
|---|---|
| ***B41J 2/14*** | (2006.01) |
| ***B41J 2/16*** | (2006.01) |
| ***B41J 2/045*** | (2006.01) |

(52) U.S. Cl.

CPC ..... *B41J 2/1623* (2013.01); *B41J 2/0458* (2013.01); *B41J 2/1404* (2013.01); *B41J 2/14024* (2013.01); *B41J 2/1433* (2013.01); *B41J 2/1628* (2013.01); *B41J 2/1629* (2013.01)

(58) Field of Classification Search

CPC ..... B41J 2/1623; B41J 2/1631; B41J 2/1632; B41J 2/14072; B41J 2/26; B41J 2002/14491; B41J 2/1621

USPC ..... 347/56, 50, 47; 29/890.01

See application file for complete search history.

(56) References Cited

U.S. PATENT DOCUMENTS

| | | | | |
|---|---|---|---|---|
| 4,455,192 | A * | 6/1984 | Tamai | 216/27 |
| 5,141,596 | A * | 8/1992 | Hawkins et al. | 216/2 |
| 6,143,190 | A * | 11/2000 | Yagi et al. | 216/27 |
| 6,190,492 | B1 * | 2/2001 | Byrne | B41J 2/1603 156/273.7 |
| 6,213,587 | B1 * | 4/2001 | Whitman | B41J 2/1404 347/47 |
| 6,322,201 | B1 | 11/2001 | Beatty et al. | |
| 6,378,994 | B1 * | 4/2002 | Ueda et al. | 347/65 |
| 6,402,301 | B1 * | 6/2002 | Powers et al. | 347/63 |
| 6,557,967 | B1 * | 5/2003 | Lee | 347/20 |
| 6,868,605 | B2 * | 3/2005 | Maeng et al. | 29/890.1 |
| 7,254,890 | B2 * | 8/2007 | Barnes | B41J 2/14024 29/413 |
| 7,293,859 | B2 * | 11/2007 | Kubota et al. | 347/65 |
| 7,536,785 | B2 * | 5/2009 | Arakawa et al. | 29/890.1 |
| 7,591,071 | B2 | 9/2009 | Ibe et al. | |
| 7,753,469 | B2 * | 7/2010 | Silverbrook | 347/20 |
| 7,762,647 | B2 | 7/2010 | Mehta et al. | |
| 7,802,872 | B2 | 9/2010 | Conta et al. | |
| 7,966,728 | B2 | 6/2011 | Buswell | |
| 8,109,608 | B2 * | 2/2012 | Fannin | B41J 2/1404 264/154 |
| 8,110,117 | B2 * | 2/2012 | Wang et al. | 216/2 |
| 8,449,783 | B2 * | 5/2013 | Watanabe | 216/27 |
| 2006/0082256 | A1 * | 4/2006 | Bibl et al. | 310/328 |

(Continued)

*Primary Examiner* — Matthew Luu
*Assistant Examiner* — Patrick King
(74) *Attorney, Agent, or Firm* — Allen, Dyer, Doppelt, Milbrath & Gilchrist, P.A.

(57) ABSTRACT

A method of making inkjet print heads may include forming recesses in a first surface of a first wafer to define inkjet chambers. The method may also include forming openings extending from a second surface of the first wafer through to respective ones of the inkjet chambers to define inkjet orifices. The method may further include forming a second wafer including ink heaters, and joining the first and second wafers together so that the ink heaters are aligned within respective inkjet chambers to thereby define the inkjet print heads.

16 Claims, 15 Drawing Sheets

(56) References Cited

U.S. PATENT DOCUMENTS

2007/0076053 A1* 4/2007 Hart ..... B41J 2/1603
347/47
2010/0110144 A1* 5/2010 Bibl et al. ..... 347/47
2010/0141709 A1* 6/2010 DeBrabander et al. ..... 347/47
2011/0181664 A1* 7/2011 Nepomnishy et al. ..... 347/47
2013/0278673 A1* 10/2013 Takeuchi ..... 347/33

* cited by examiner

METHOD OF MAKING INKJET PRINT HEADS HAVING INKJET CHAMBERS AND ORIFICES FORMED IN A WAFER AND RELATED DEVICES

FIELD OF THE INVENTION

The present invention relates to inkjet printers, and more particularly, to methods of making inkjet print heads.

BACKGROUND OF THE INVENTION

Modern ink jet printers may produce photographic-quality images. An inkjet printer includes a number of orifices or nozzles spatially positioned in a printer cartridge. Ink is heated when an electrical pulse energizes a resistive element forming a thermal resistor. The ink resting above the thermal resistor is ejected through the orifice towards a printing medium, such as an underlying sheet of paper as a result of the applied electrical pulse.

The thermal resistor is typically formed as a thin film resistive material on a semiconductor substrate as part of a semiconductor chip, for example. Several thin film layers may be formed on the semiconductor chip, including a dielectric layer carried by the substrate, a resistive layer forming the thermal resistor, and an electrode layer that defines electrodes coupled to the resistive layer to which the pulse is applied to heat the thermal resistor and vaporize the ink.

An orifice plate is typically placed onto the print head die stack or the layers described above, for example, by a pick-and-place technique. The orifice plate is typically a metallic or a polymeric material. These materials may be particularly costly, and may have special equipment requirements and limitations with respect to thickness, and thus to inkjet chamber and inkjet orifice dimensions. By using a metallic or polymeric orifice plate, increased consideration may be given to the effects of different of thermal expansion (CTEs) since the substrate and the orifice plate are different materials.

SUMMARY

A method of making a plurality of inkjet print heads may include forming a plurality of recesses in a first surface of a first wafer to define a plurality of inkjet chambers. The method may also include forming a plurality of openings extending from a second surface of the first wafer through to respective ones of the inkjet chambers to define a plurality of inkjet orifices. The method may further include forming a second wafer including a plurality of ink heaters, and joining the first and second wafers together so that the plurality of ink heaters are aligned within respective inkjet chambers to thereby define the plurality of inkjet print heads. Accordingly, the inkjet print heads may be made more efficiently and may be more robust. Greater accuracy may be obtained with respect to the inkjet orifices and inkjet chambers.

Forming the second wafer may include forming control circuitry coupled to the plurality of ink heaters, for example. The method may further include dividing the joined-together first and second wafers into a plurality of individual inkjet print heads.

The first wafer may include monocrystalline silicon, for example. The monocrystalline silicon may have a <100> crystalline orientation. The method may further include reducing a thickness of the first wafer from the second side thereof.

Joining may include joining the first and second wafers together with an adhesion layer therebetween, for example.

Joining the first and second wafers together may be performed prior to forming the plurality of openings. Forming the plurality of recesses may include forming the plurality of recesses by at least one of wet etching and reactive ion etching.

A device aspect is directed to an inkjet print head that may include a first substrate comprising monocrystalline material having a plurality of recesses in a first surface thereof to define a plurality of inkjet chambers. The first substrate may also have a plurality of openings extending from a second surface thereof through to respective ones of the inkjet chambers to define a plurality of inkjet orifices. The inkjet print head may also include a second substrate joined to the first substrate. The second substrate may include a plurality of ink heaters and control circuitry coupled thereto with the plurality of ink heaters being aligned within respective inkjet chambers.

DETAILED DESCRIPTION

The embodiments will now be described more fully hereinafter with reference to the accompanying drawings, in which preferred embodiments are shown. The embodiments may, however, be in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout and prime and multiple prime notation is used to describe like elements in different embodiments.

Figure 1:
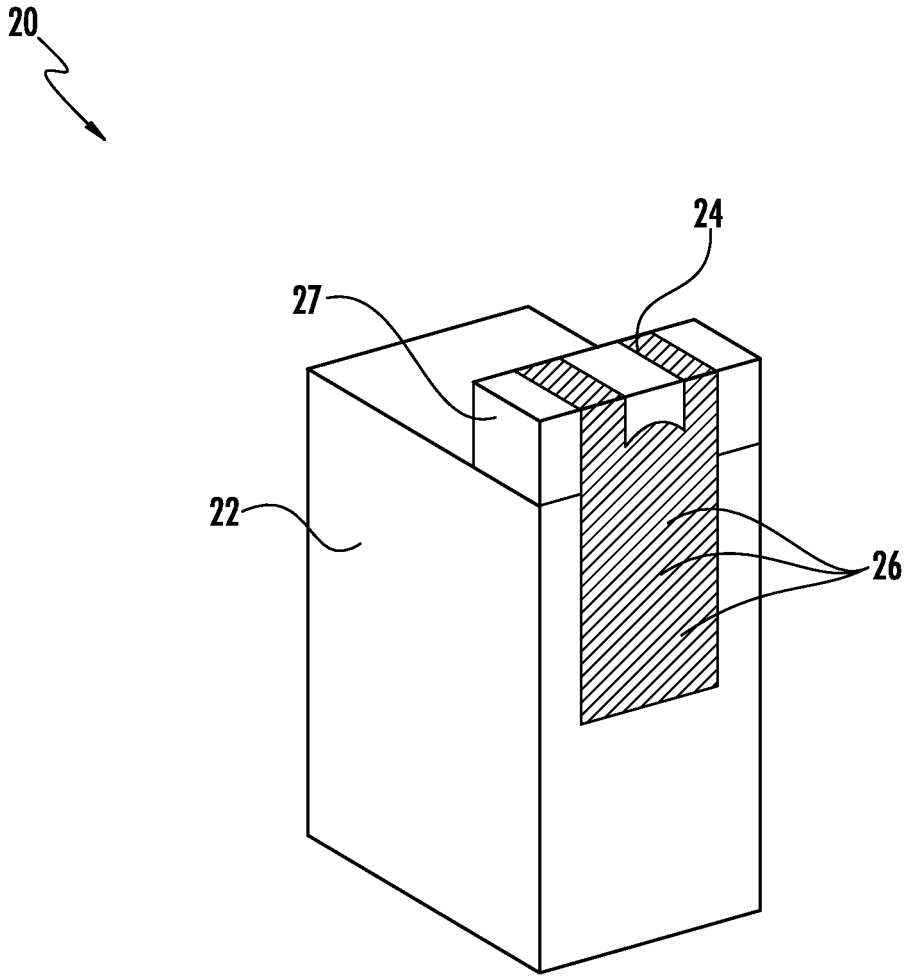
FIG. 1 is a perspective view of an inkjet print head cartridge that incorporates an inkjet print head made according to the invention.

Referring initially to FIG. 1, an inkjet print head cartridge 20 is now described. This inkjet print cartridge 20 includes a cartridge body 22 that includes ink, for example, for an inkjet print head. The ink is channeled into a plurality of inkjet chambers, each associated with a respective orifice 24 or print head nozzle positioned on the body 22 and configured to eject ink onto the paper or other print media. Electrical signals are provided to conductive traces 26 to energize thermal resistors that heat the ink and eject a droplet of ink through an associated orifice 24.

The orifices 24 are typically located at an inkjet print head 27 of the print head cartridge 20. In an example, the print head cartridge 20 may include 300 or more orifices 24, each orifice 24 having an associated inkjet chamber 30, as will be appreciated by those skilled in the art. During manufacture, many print heads 27 may be formed on a single silicon wafer and separated. Such methods of making inkjet print heads are described in further detail below.

Figure 2:
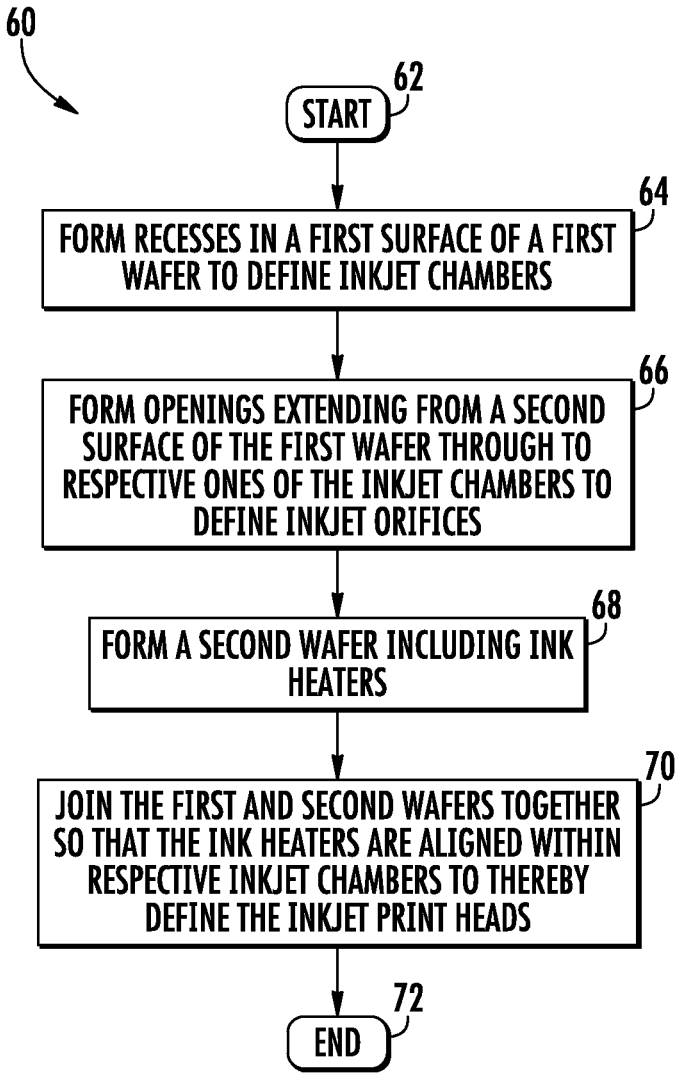
FIG. 2 is a flowchart of a method of making inkjet print heads in accordance with the invention.
Figure 3:
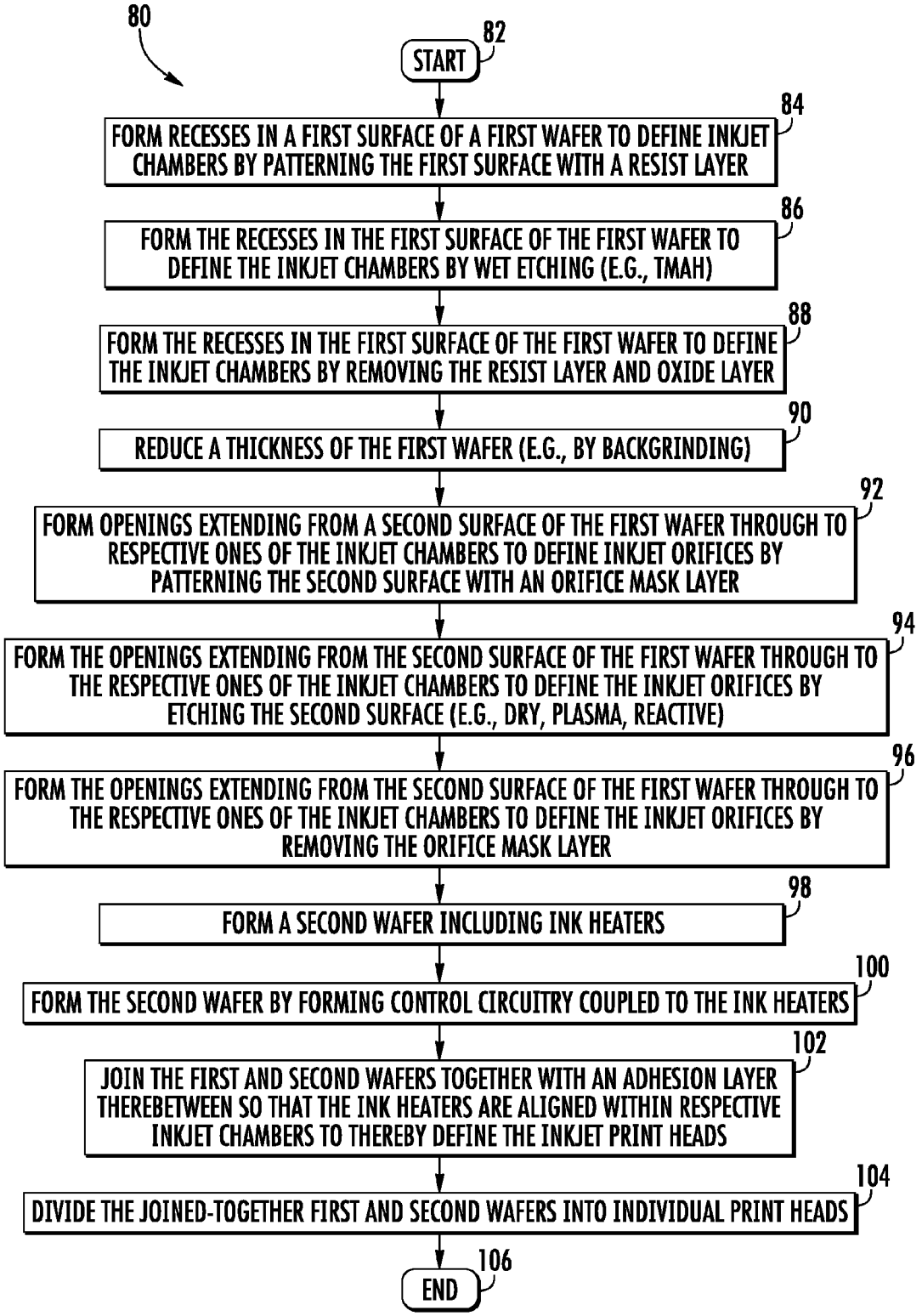
FIG. 3 is a flowchart of a more detailed method of making inkjet print heads in accordance with the invention.

Referring now to the flowchart 60 in FIG. 2, a method of making inkjet print heads is described. Beginning at Block 62, the method includes forming recesses in a first surface of a first wafer to define inkjet chambers (Block 64). At Block 66, the method includes forming openings extending from a second surface of the first wafer through to respective ones of the inkjet chambers to define inkjet orifices. The method also includes forming a second wafer including ink heaters (Block 68). At Block 70, the method includes joining the first and second wafers together so that the ink heaters are aligned within respective inkjet chambers to thereby define the inkjet print heads 27. The method ends at Block 72.

Referring now to the flowchart 80 in FIG. 3 and FIGS. 4*a*-4*f*, a more detailed method of making inkjet print heads 27 is now described. It should be noted that while reference is made to multiple orifices and inkjet chambers, for ease of understanding, a single orifice and inkjet chamber are illustrated.

Figure 4A:
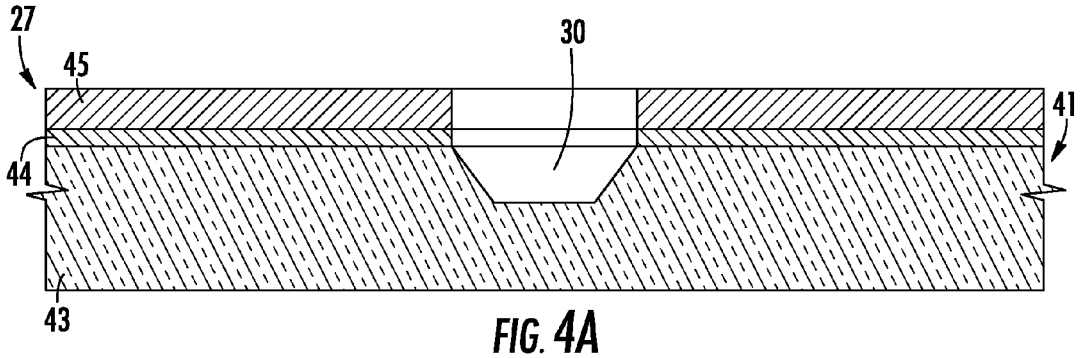
FIG. 4*a* is a schematic cross-sectional view of recesses in a first wafer made according to the method of FIG. 3.

Beginning at Block 82, the method includes forming recesses in a first surface 42 of a first wafer 41 or substrate to define inkjet chambers 30. In particular, the first wafer 41 may include a substrate layer 43 and an oxide layer 44 carried by the substrate layer. At Block 84, the recesses may be formed by patterning the first surface 42 with an inkjet chamber mask or resist layer 45 (FIG. 4*a*).

The first wafer 41 may include monocrystalline silicon, for example. In some embodiments, the monocrystalline silicon has a <100> crystalline orientation. Of course, the monocrystalline silicon may have another crystalline orientation, which may, for example, be based upon desired dimensions of the inkjet chambers 30, which will be described in further detail below. At Block 86, the recesses are formed via wet etching (FIG. 4*a*). The silicon is etched to a desired depth a, for example, between 20-30 microns. The etching may be performed using, for example, tetramethylammonium hydroxide (TMAH). Of course, other wet etchants may be used. In other embodiments, the recesses that define the inkjet chambers 30 may be formed by reactive or dry etching, as will be described below.

Figure 4B:
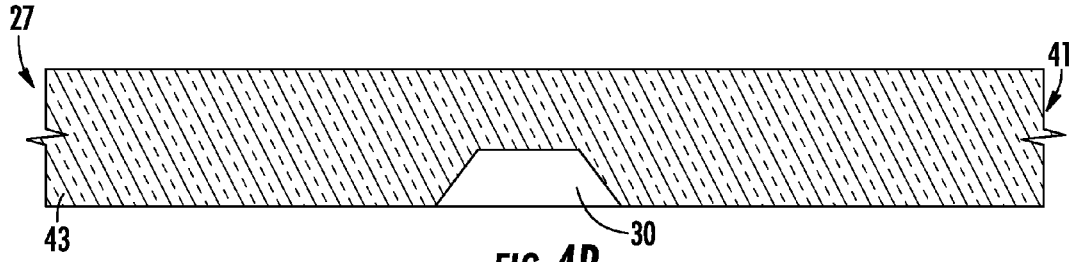
FIG. 4*b* is a schematic cross-sectional view of the first wafer with the oxide and resist layers removed according to the method of FIG. 3.
Figure 4C:
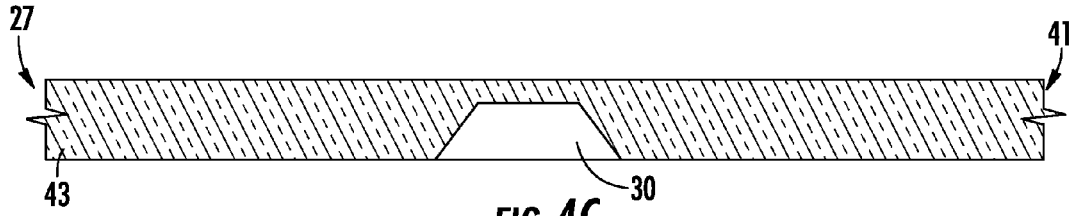
FIG. 4*c* is a schematic cross-sectional view of the first wafer after reducing a thickness of the first wafer according to the method of FIG. 3.

At Block 88, the recesses are formed by removing the resist layer 45 and oxide layer 45 (FIG. 4*b*). The first wafer 41 may also be turned over for processing. A thickness of the first wafer 41 is reduced at Block 90 (FIG. 4*c*). For example, the thickness of the first wafer 41 may be reduced by backgrinding a second surface 46 of the first wafer 41 until a desired thickness b is achieved. For example, backgrinding may be performed until the first wafer 41 has a thickness of 10 microns more than the etching depth of the inkjet chambers 30.

Figure 4D:
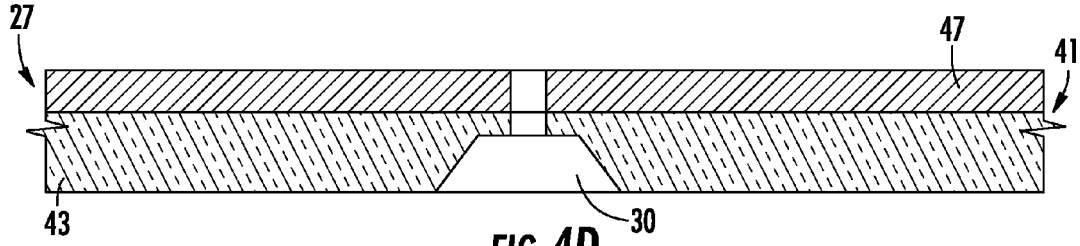
FIG. 4*d* is a schematic cross-sectional view of the first wafer with openings being formed therein according to the method of FIG. 3.
Figure 4E:
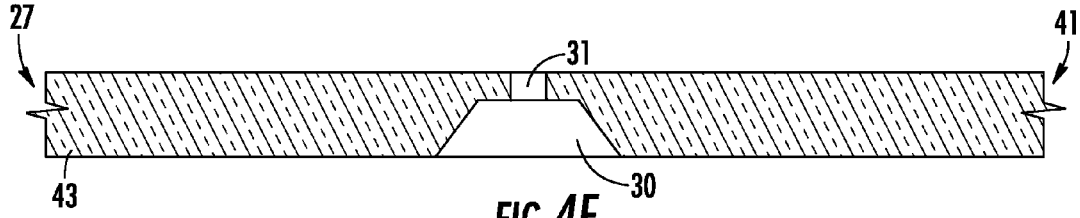
FIG. 4*e* is a schematic cross-sectional view of the first wafer with the orifice mask layer removed according to the method of FIG. 3.

At Block 92, the method includes forming openings extending form the second surface 46 through to respective ones of the inkjet chambers 30 to define inkjet orifices 31 by patterning the second surface with an orifice mask layer 47 (FIG. 4*d*). At Block 94, the openings are further formed by etching the second surface 46, for example, using a dry plasma etching that does not use an oxide layer. Of course, other etching techniques may be used, for example, a wet etching technique. The openings are further formed at Block 96 by removing the orifice mask layer 47 (FIG. 4*e*).

In some embodiments, the inkjet orifices 31 and the inkjet chambers 30 may be aligned using an infrared camera, for example. Of course, other alignment techniques may be used.

It will be appreciated by those skilled in the art that by using a dry etching technique, for example, a dry plasma etching of the monocrystalline silicon first wafer 41 the vertical profile of the inkjet orifices 31 may be more controllable. In particular, the inkjet orifices 31 may have a vertical profile as illustrated in FIG. 4*e*, for example.

Figure 5A:
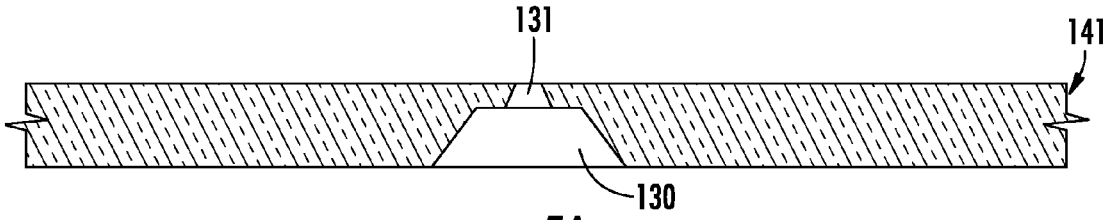
FIG. 5*a* is a schematic cross-sectional view of a first wafer illustrating an inkjet orifice formed according to the invention.

By manipulating the etching conditions at Block 96, for example, other vertical profiles of the inkjet orifices 131 may be obtained having positive or negative slopes, as illustrated in FIG. 5*a*. The inkjet chamber 130 is formed in the first wafer 141 or substrate as described above.

Figure 5B:
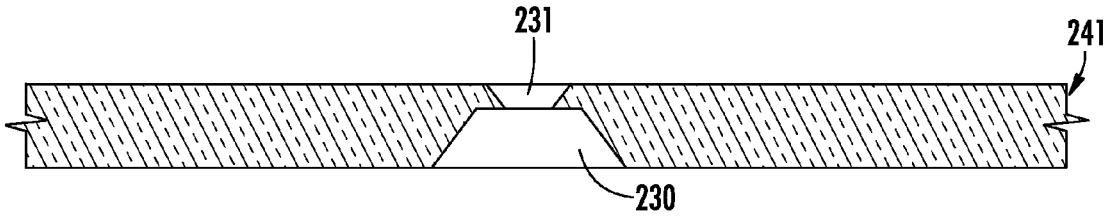
FIG. 5*b* is another schematic cross-sectional view of a first wafer illustrating an inkjet orifice formed according to the invention.

In some embodiments, for example, as illustrated in FIG. 5*b*, the openings may be formed by wet etching the monocrystalline silicon of the first wafer, for example, with TMAH, to define the inkjet orifices 231. Of course, as will be appreciated by those skilled in the art, an oxide mask layer and a resist layer would be used in a wet etching process. The resultant vertical profile of the inkjet orifices 231 may be fixed around 54.7° based upon the <100> crystalline orientation of the monocrystalline silicon. The inkjet chamber 230 is formed in the first wafer 241 or substrate as described above.

Figure 4F:
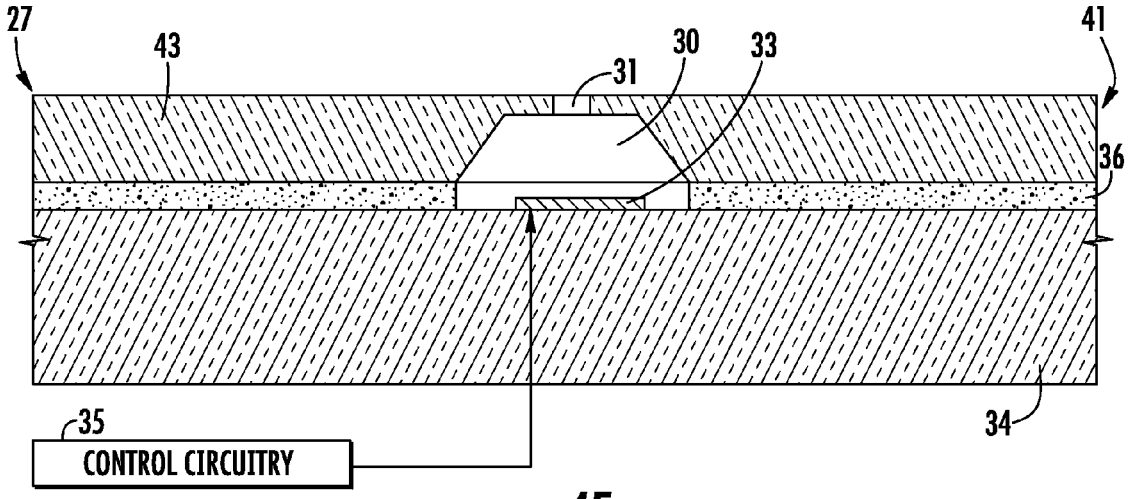
FIG. 4*f* is a schematic cross-sectional view of joined-together first and second wafers according to the method of FIG. 3.

The method also includes forming a second wafer 34 that includes ink heaters 33 at Block 98 (FIG. 4*f*). At Block 100, the method also includes forming the second wafer 34 by forming control circuitry 35 coupled to the inkjet heaters 33 (FIG. 4*f*).

The first and second wafers 31, 34 are joined together at Block 102 with an adhesion layer 36 therebetween so that the ink heaters 33 are aligned within respective inkjet chambers 30 to thereby define the inkjet print heads 27. As will be appreciated by those skilled in the art, the adhesion layer 36 may be considered to become a permanent part of the composite structure or inkjet print head 27. The adhesion layer 36 may be a photosensitive polymer layer that may be cured for desired performance. The adhesion layer 36 has the same or similar pattern as the resist layer 45 (i.e., mask) for the inkjet chamber 30, as will be appreciated by those skilled in the art.

At Block 104, the joined-together first and second wafers are divided into individual inkjet print heads 27. The method ends at Block 106.

Figure 6:
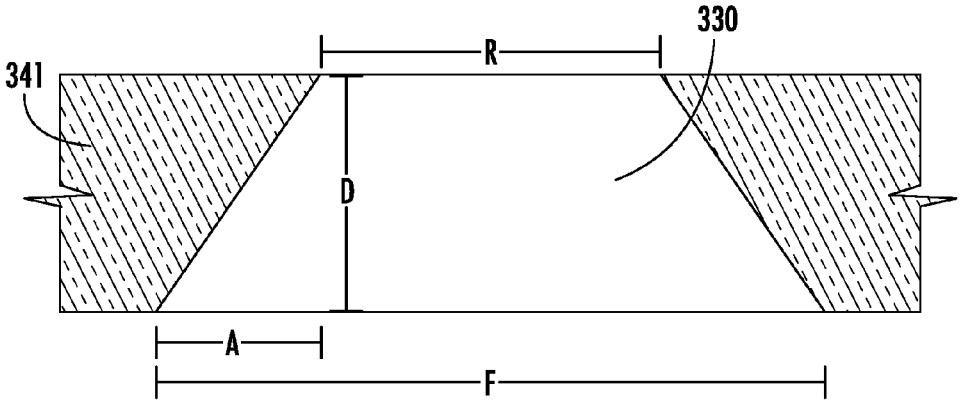
FIG. 6 is an enlarged schematic cross-sectional view of a portion of a first wafer illustrating example dimension of the recesses defining the inkjet chambers according to an embodiment of the invention.

Referring now to FIG. 6, geometric limitations that may be associated with wet etching are now discussed. In particular, such limitations may be associated with wet etching of the <100> crystalline silicon. The dimensions A, D, and R are all related to the angle 54.7°, which is a characteristic of the monocrystalline silicon structure with a <100> orientation. For example, the height D of the inkjet chambers 330 formed in the first wafer 341 may be 20 microns and 2A=28.3 microns. Thus a relatively small roof R of 12 microns corresponds to an inkjet chamber floor F of 40.3 microns wide.

By using a first wafer 41 having a different crystalline orientation it may be possible to achieve other wet etch profiles. For example, a more vertical profile may be preferred when multiple inkjet chambers with a relatively small separation therebetween are desired.

Indeed, according to the method embodiments, the inkjet chamber 30 and the inkjet orifice 31 are formed monolithically in a single piece of silicon or wafer 41. As will be appreciated by those skilled in the art, the wafer may be a low cost test wafer, for example. By using a single silicon wafer 41 the inkjet orifice 31 and inkjet chamber 30 may be formed in a way that the inkjet chamber and inkjet orifice dimensions may be more controllable by using semiconductor manufacturing techniques, and using conventional semiconductor equipment and inexpensive photoresists. This may thus result in a reduced manufacturing cost, with respect to prior art methods where, a fluid chamber and an orifice are formed separately using the same or different materials, for example, photo-definable polymeric materials, which tend to be expensive and may present special equipment requirements and present limitations with respect to thickness and therefore also to chamber or orifice dimensions. Moreover, an interface is typically formed between the materials used to create the chamber and orifice, which may result in an undesirable CTE mismatch.

With respect to robustness, silicon has an increased chemical resistance to many fluids over a wide range of pH such as the inks used in inkjet printers. As described above, the first wafer 41 or monolithic chamber/orifice substrate may be bonded to another wafer (i.e., the second wafer 34) or substrate. In the present embodiments the first and second wafers 41, 34 may each be a same material, for example, silicon, which advantageously provide a relatively close match with or the same CTE.

Figure 7:
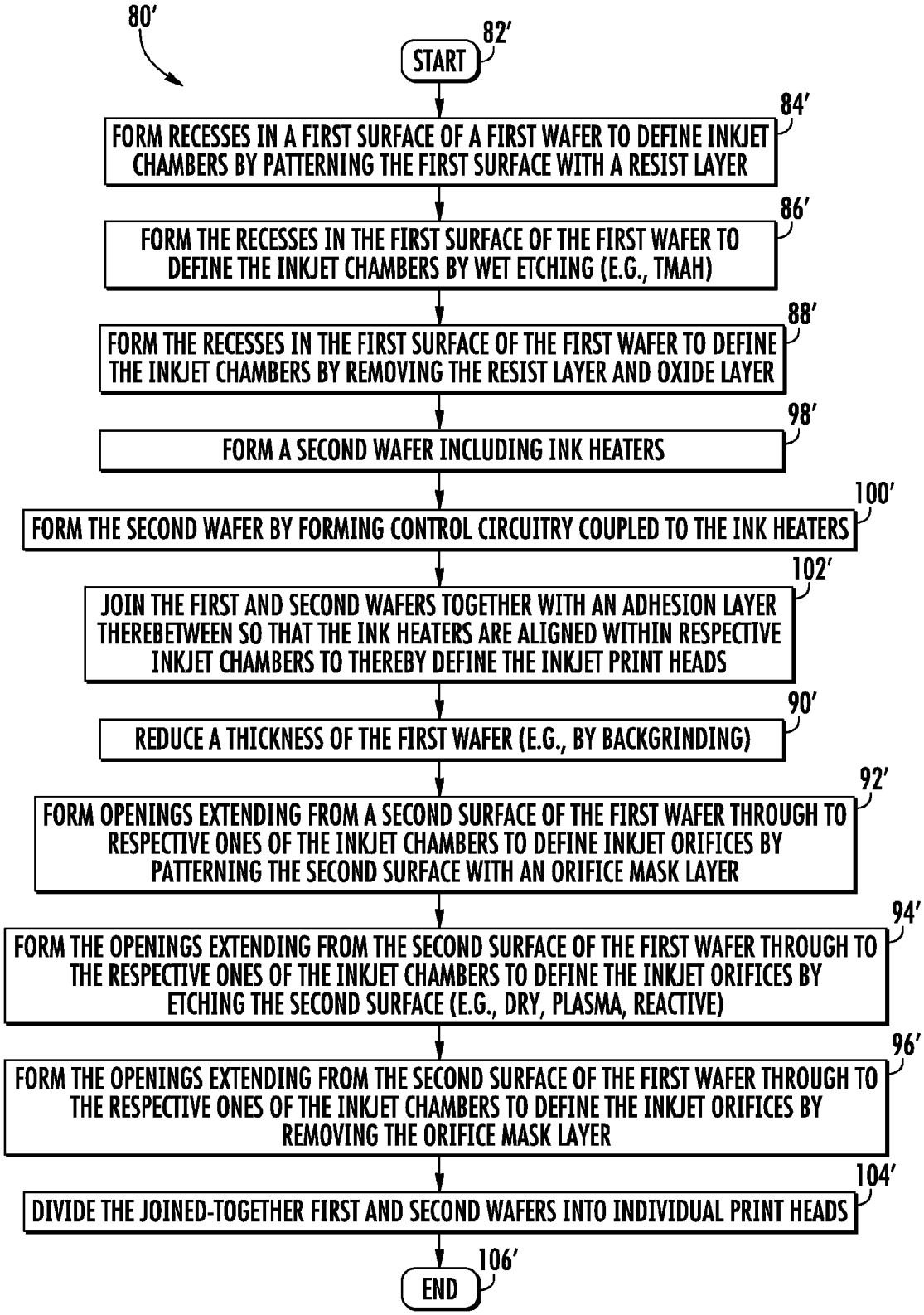
FIG. 7 is a flowchart of a method of making inkjet print heads in accordance with another embodiment of the invention.
Figure 8A:
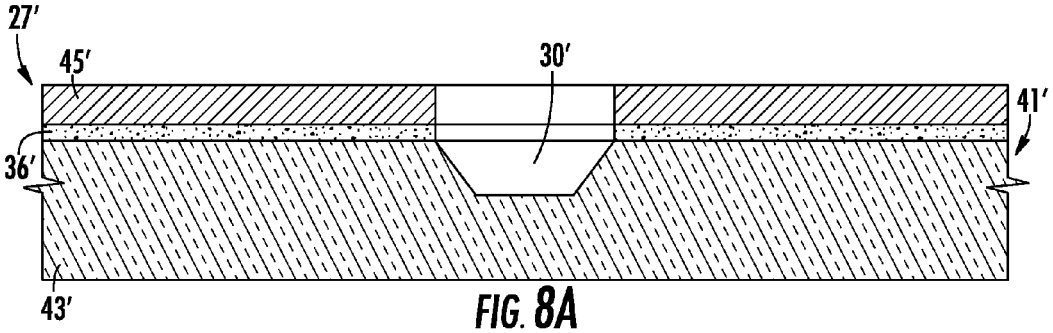
FIG. 8*a* is a schematic cross-sectional view of recesses in a first wafer made according to the method of FIG. 7.
Figure 8B:
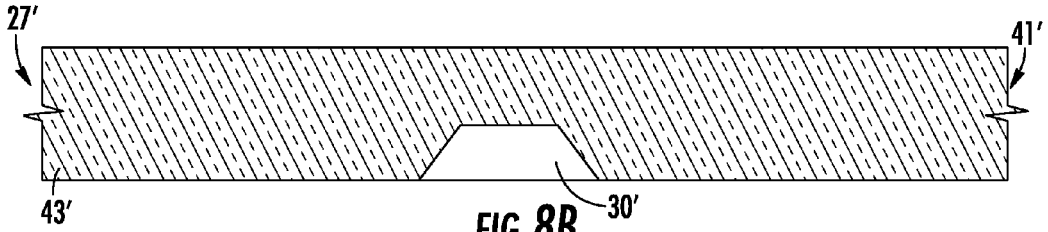
FIG. 8*b* is a schematic cross-sectional view of the first wafer with the oxide and resist layers removed according to the method of FIG. 7.
Figure 8C:
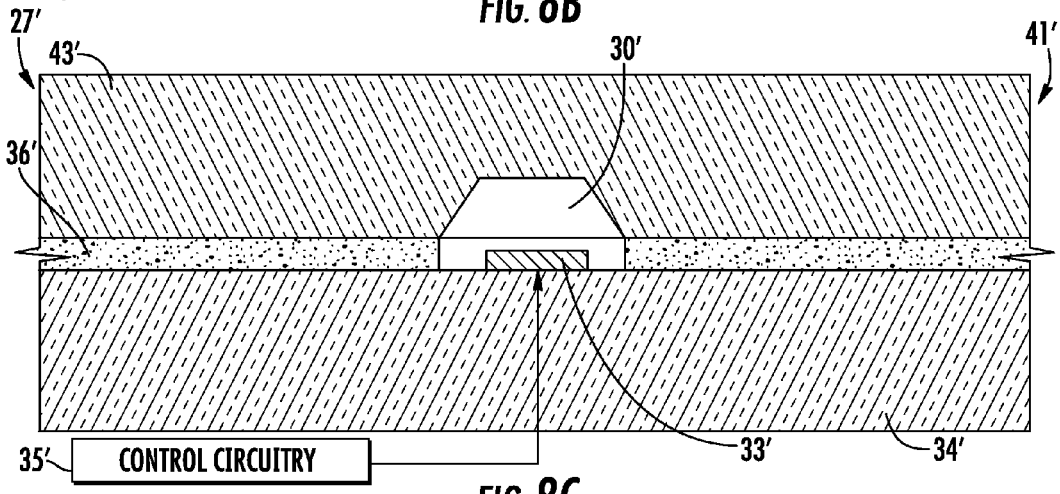
FIG. 8*c* is a schematic cross-sectional view of the first wafer after reducing a thickness of the first wafer according to the method of FIG. 7.
Figure 8D:
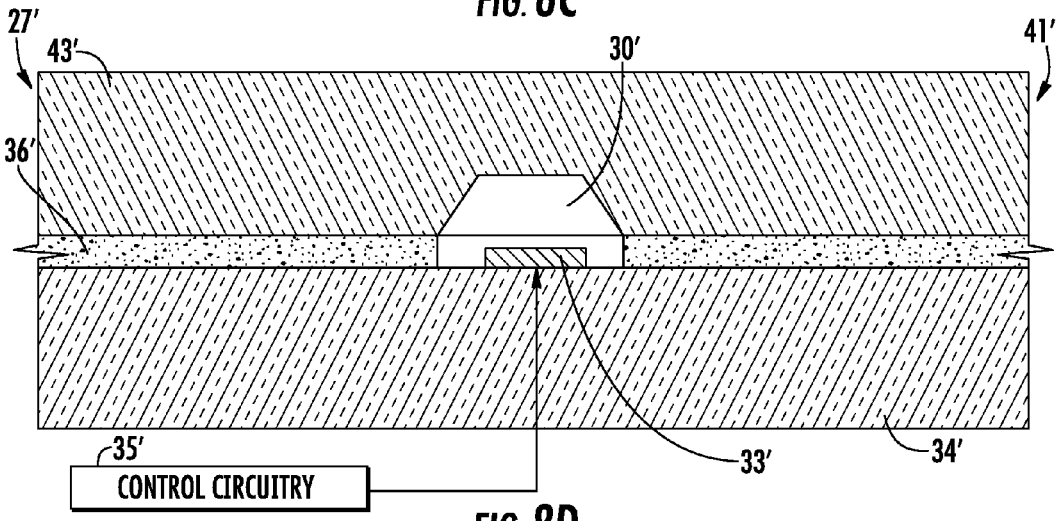
FIG. 8*d* is a schematic cross-sectional view of the first wafer with openings being formed therein according to the method of FIG. 7.
Figure 8E:
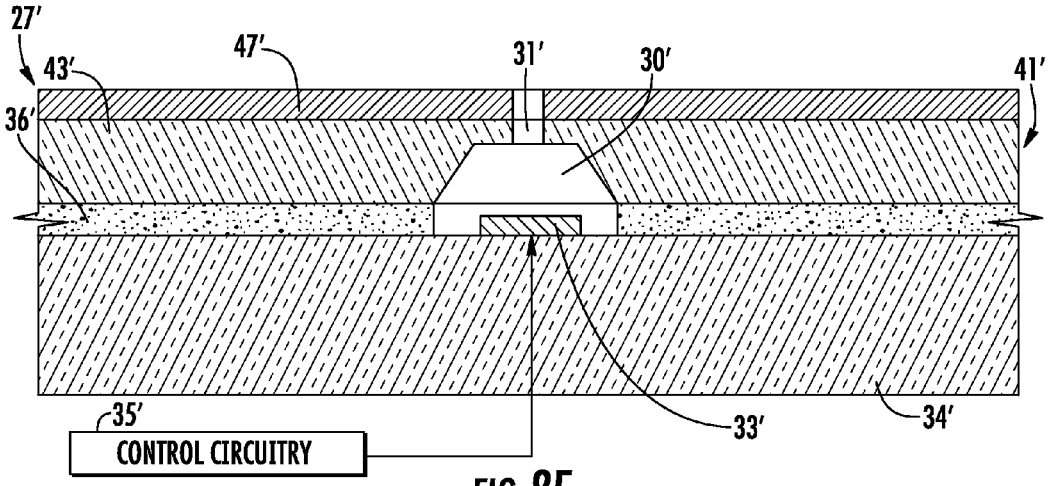
FIG. 8*e* is a schematic cross-sectional view of the first wafer with the orifice mask layer removed according to the method of FIG. 7.
Figure 8F:
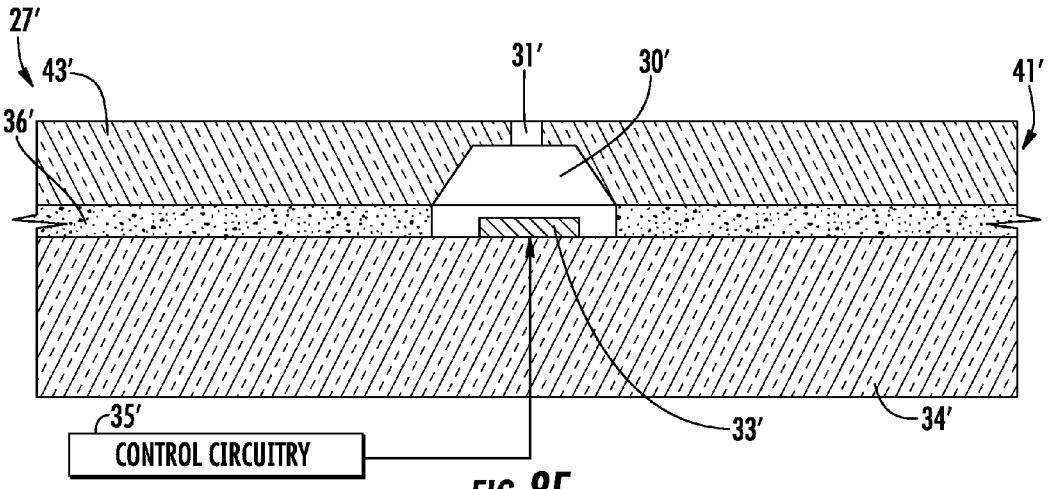
FIG. 8*f* is a schematic cross-sectional view of joined-together first and second wafers according to the method of FIG. 7.
Figure 9:
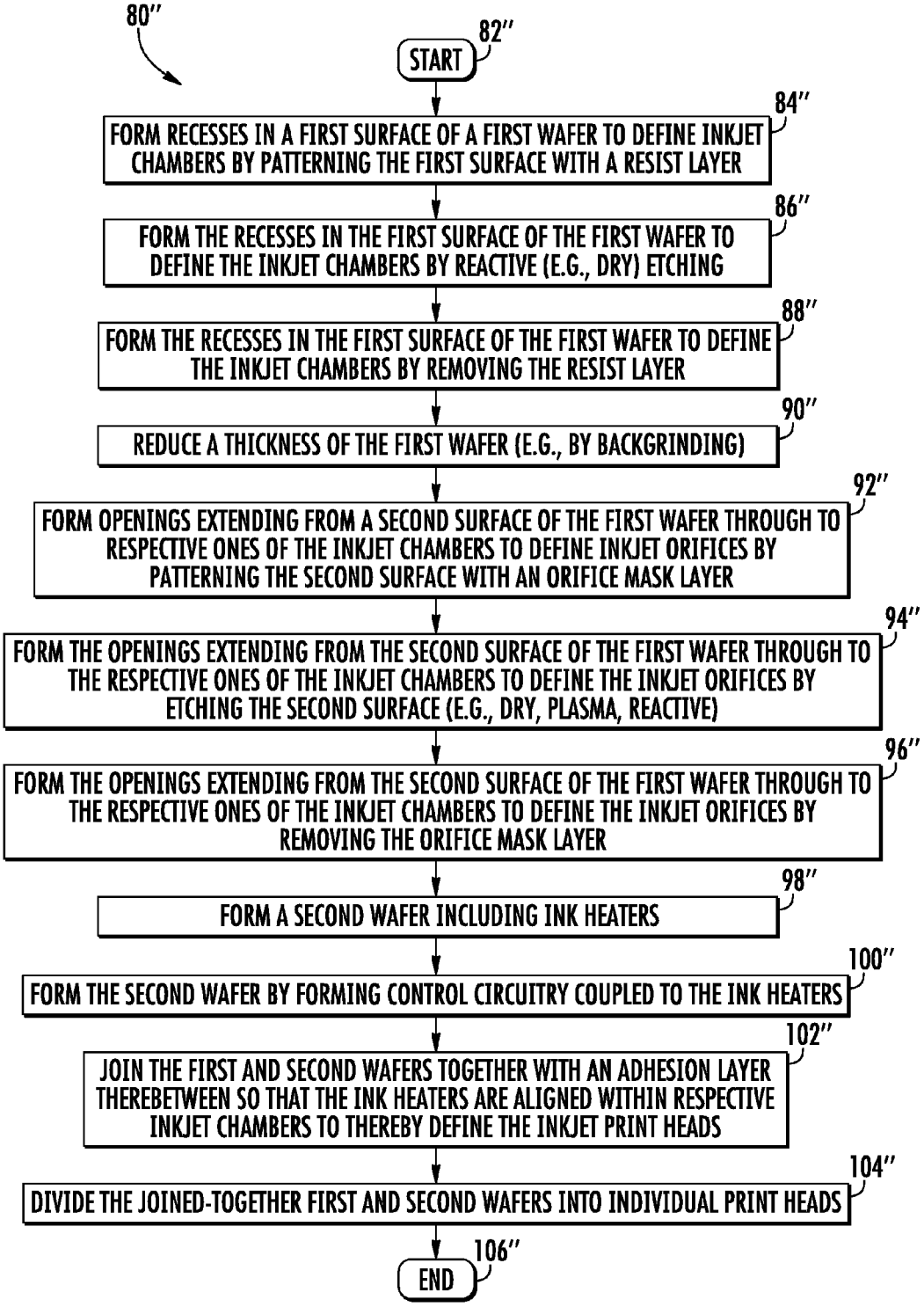
FIG. 9 is a flowchart of a method of making inkjet print heads in accordance with another embodiment of the invention.

Referring now to the flowchart 80' in FIG. 7, and FIGS. 8*a*-8*f*, in another embodiment, the openings that define the inkjet orifices 31' are formed after the first and second wafers 41', 34' are joined together, as illustrated more particularly in FIGS. 8*e*-8*f*. In other words, joining the first and second wafers 41', 34' together is performed prior to forming the openings that define the inkjet orifices 31'. Additionally, the thickness of the first wafer 41', i.e., backgrinding, may be performed after joining the first and second wafers 41', 34', but prior to forming the openings that define the inkjet orifices 31'. The other method steps illustrated in the flowchart 80' in FIG. 7 are similar to the method steps described above with respect to the flowchart in FIG. 3.

Figure 10A:
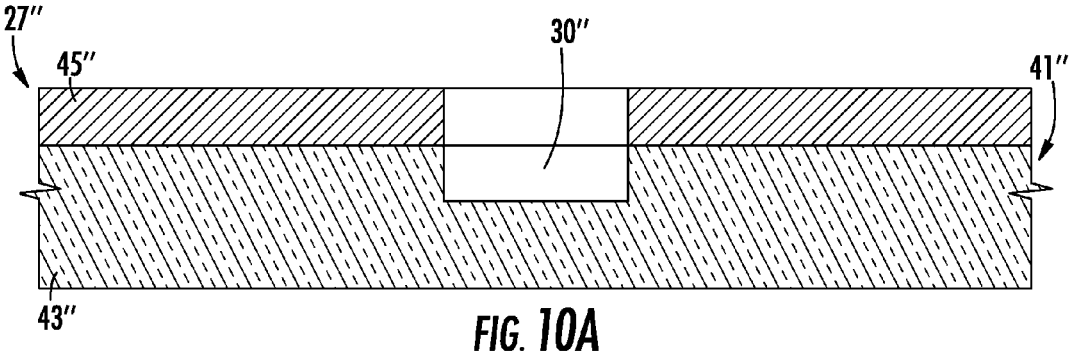
FIG. 10*a* is a schematic cross-sectional view of recesses in a first wafer made according to the method of FIG. 9.
Figure 10B:
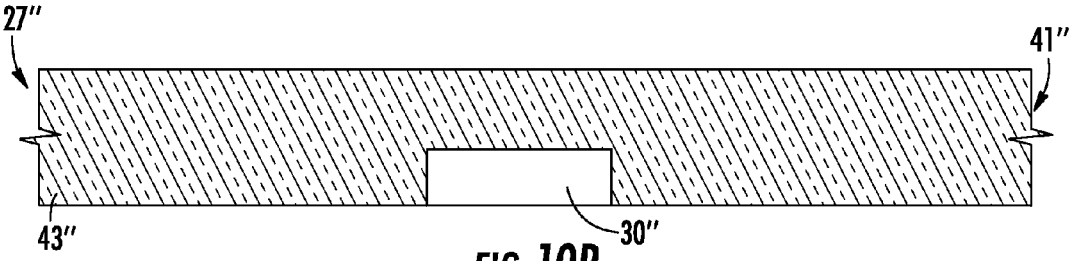
FIG. 10*b* is a schematic cross-sectional view of the first wafer with the resist layer removed according to the method of FIG. 9.
Figure 10C:
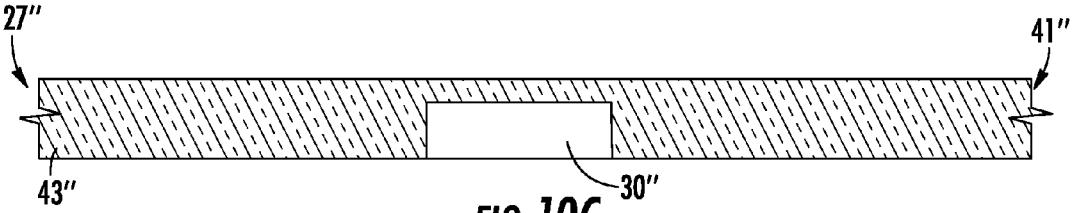
FIG. 10*c* is a schematic cross-sectional view of the first wafer after reducing a thickness of the first wafer according to the method of FIG. 9.
Figure 10D:
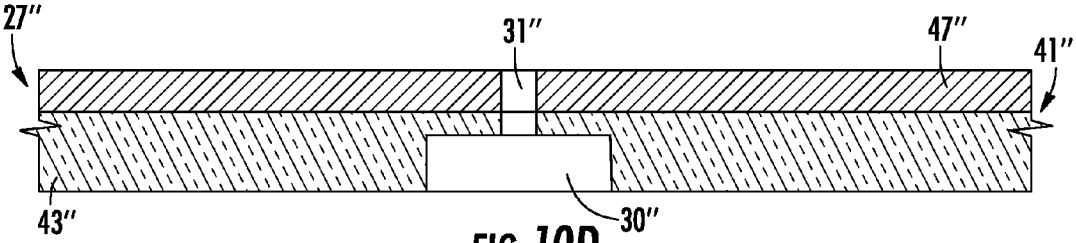
FIG. 10*d* is a schematic cross-sectional view of the first wafer with openings being formed therein according to the method of FIG. 9.
Figure 10E:
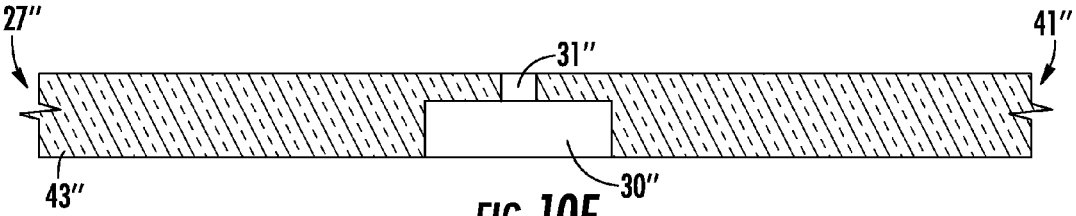
FIG. 10*e* is a schematic cross-sectional view of the first wafer with the orifice mask layer removed according to the method of FIG. 9.
Figure 10F:
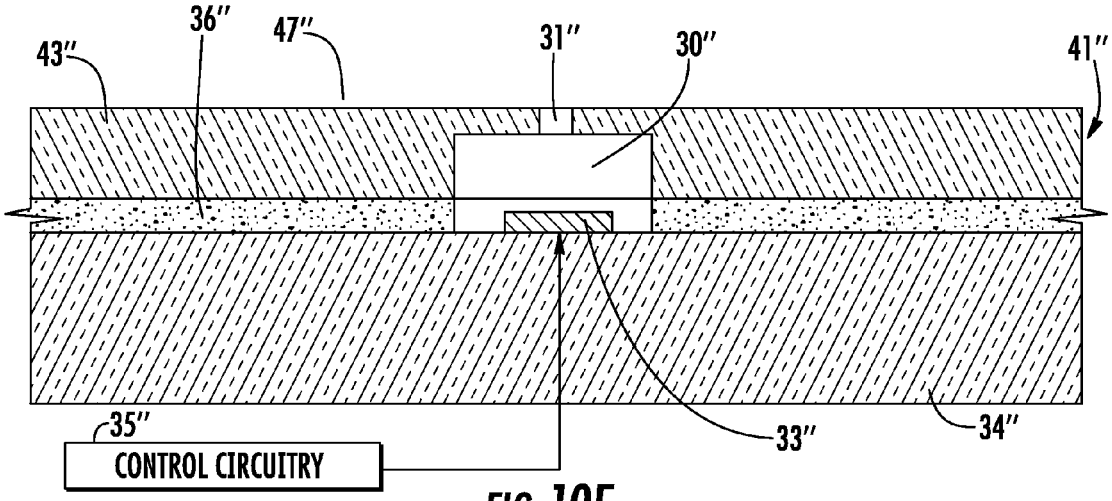
FIG. 10*f* is a schematic cross-sectional view of joined-together first and second wafers according to the method of FIG. 9.
Figure 11:
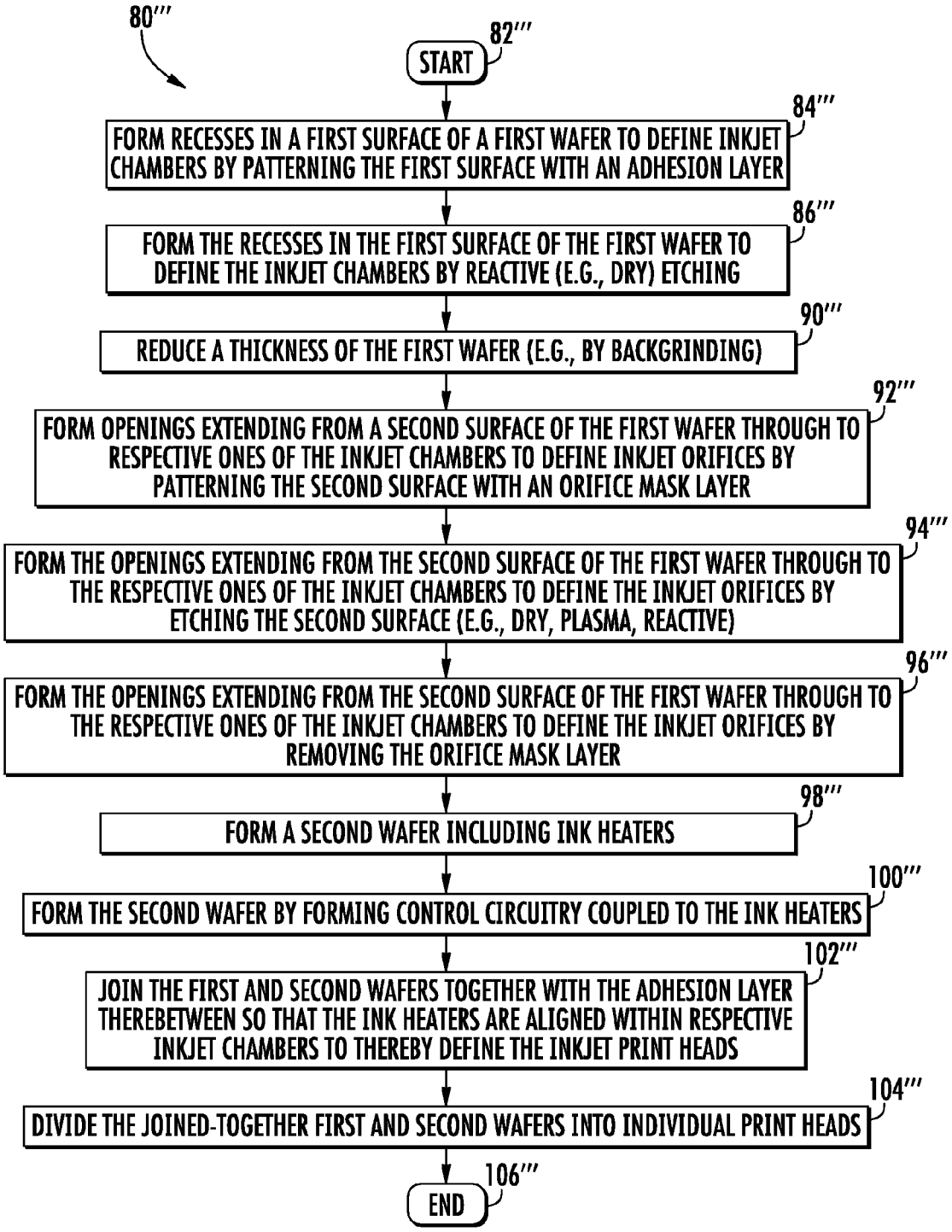
FIG. 11 is a flowchart of a method of making inkjet print heads in accordance with another embodiment of the invention.

Referring now to the flowchart 80" in FIG. 9 and FIGS. 10*a*-10*f*, in another embodiment, the recesses in the first surface 42" of the first wafer 41" that define that inkjet chambers 30" are formed by dry etching, for example, using a dry plasma etching (Block 86"). Thus, the inkjet chambers 30" may have a more rectangular shape as opposed to angles of about 54° with wet etching. An oxide layer is not used, but rather just an orifice mask layer 47" (FIG. 10*a*). In other words, the recesses and openings are both formed by reactive or dry etching. The other method steps are similar to those described above with respect to the flowchart in FIG. 3.

Figure 12A:
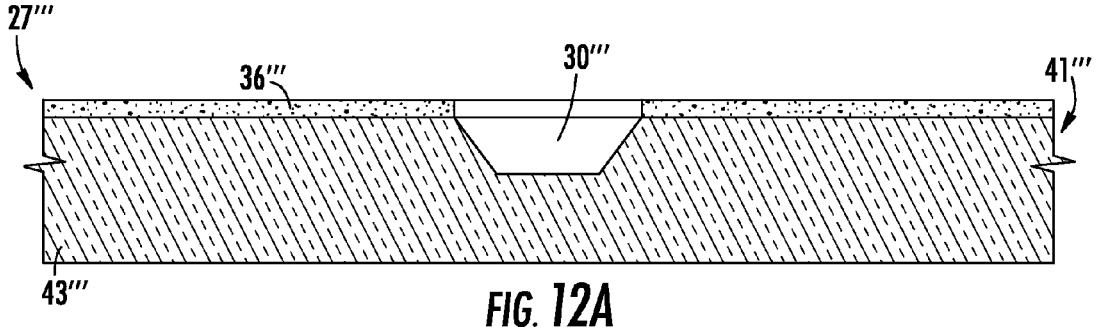
FIG. 12*a* is a schematic cross-sectional view of recesses in a first wafer made according to the method of FIG. 11.
Figure 12B:
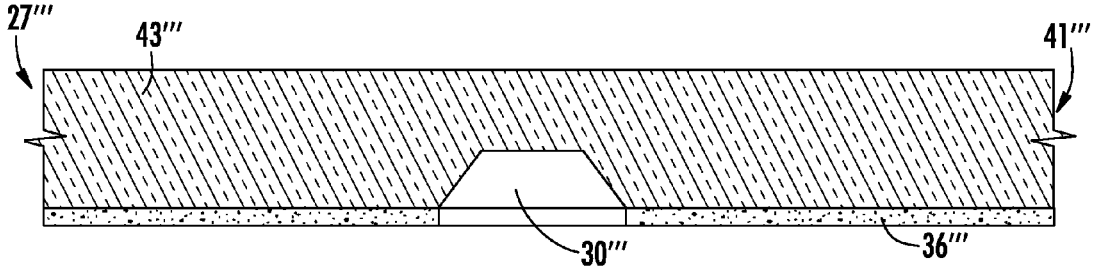
FIG. 12*b* is a schematic cross-sectional view of the first wafer with the adhesion layer maintained according to the method of FIG. 11.
Figure 12C:
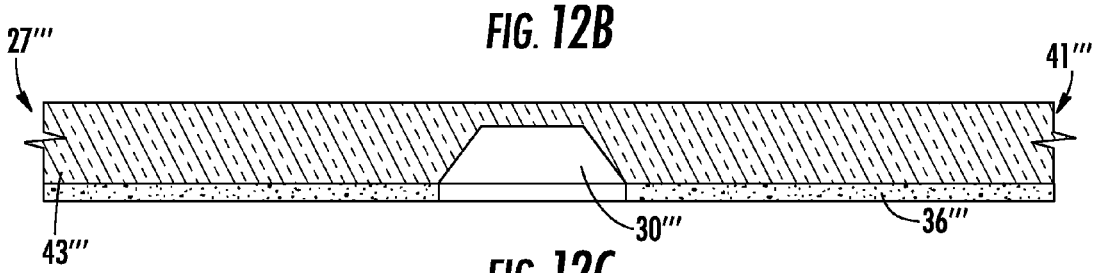
FIG. 12*c* is a schematic cross-sectional view of the first wafer after reducing a thickness of the first wafer according to the method of FIG. 11.
Figure 12D:
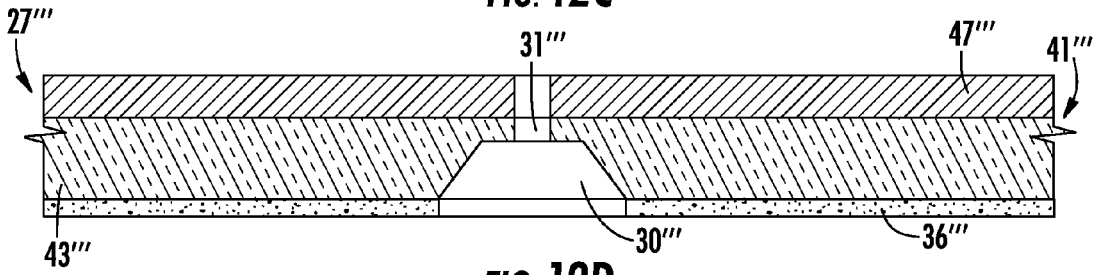
FIG. 12*d* is a schematic cross-sectional view of the first wafer with openings being formed therein according to the method of FIG. 11.
Figure 12E:
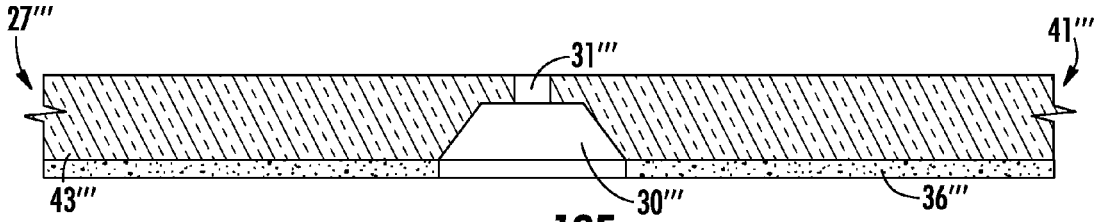
FIG. 12*e* is a schematic cross-sectional view of the first wafer with the orifice mask layer removed according to the method of FIG. 11.
Figure 12F:
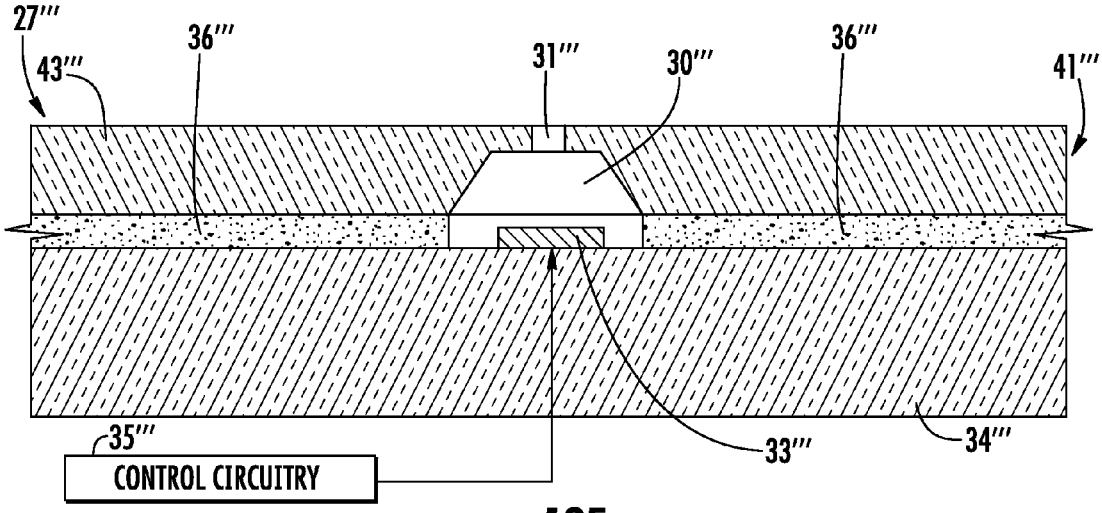
FIG. 12*f* is a schematic cross-sectional view of joined-together first and second wafers according to the method of FIG. 11.

Referring now to the flowchart 80''' in FIG. 11 and FIGS. 12*a*-12*f*, in yet another embodiment, the adhesion layer 36''' may be a photosensitive material layer that may be used as the mask or resist layer in the dry etching of the inkjet chambers 30''' (Blocks 84''' and 86'''). Thus, different from the other embodiments described above and with respect to a resist layer, the adhesion layer 36''' is not removed after etching at Block 86''' (FIG. 12*b*). The other method steps are similar to those described above with respect to the flowchart in FIG. 3.

It will be appreciated by those skilled the art, that while several embodiments that use wet etching and/or reactive ion etching, any combination of wet etching and/or reactive or dry etching may be used. Moreover, more than one opening may be formed to align with a respective inkjet orifice 31.

Many modifications and other embodiments will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A method of making a plurality of inkjet print heads comprising:

forming a plurality of recesses in a first surface of a first wafer to define a plurality of inkjet chambers in the first wafer;

forming a plurality of openings extending from a second surface of the first wafer through the first wafer to respective ones of the inkjet chambers to define a plurality of inkjet orifices, the second surface being opposite the first surface;

forming a second wafer including a plurality of ink heaters; and joining, after forming the plurality of recesses and the plurality of openings, the first and second wafers together so that the plurality of ink heaters are aligned within respective inkjet chambers to thereby define the plurality of inkjet print heads.

2. The method of claim 1, wherein forming the second wafer comprises forming control circuitry coupled to the plurality of ink heaters.

3. The method of claim 1, further comprising dividing the joined-together first and second wafers into a plurality of individual inkjet print heads.

4. The method of claim 1, wherein the first wafer comprises monocrystalline silicon.

5. The method of claim 4, wherein the monocrystalline silicon has a <100> crystalline orientation.

6. The method of claim 1, further comprising reducing a thickness of the first wafer from the second side thereof.

7. The method of claim 1, wherein joining comprises joining the first and second wafers together with an adhesion layer therebetween.

8. The method of claim 1, wherein joining the first and second wafers together is performed prior to forming the plurality of openings.

9. The method of claim 1, wherein forming the plurality of recesses comprises forming the plurality of recesses by at least one of wet etching and reactive ion etching.

10. A method of making a plurality of inkjet print heads comprising:

forming a plurality of recesses in a first surface of a first wafer comprising monocrystalline silicon to define a plurality of inkjet chambers in the first wafer;

forming a plurality of openings extending from a second surface of the first wafer through the first wafer to respective ones of the inkjet chambers to define a plurality of inkjet orifices, the second surface being opposite the first surface;

forming a second wafer including a plurality of ink heaters and control circuitry coupled thereto; and joining, after forming the plurality of recesses and the plurality of openings, the first and second wafers together so that the plurality of ink heaters are aligned within respective inkjet chambers to thereby define the plurality of inkjet print heads.

11. The method of claim 10, further comprising dividing the joined-together first and second wafers into a plurality of individual inkjet print heads.

12. The method of claim 10, wherein the monocrystalline silicon has a <100> crystalline orientation.

13. The method of claim 10, further comprising reducing a thickness of the first wafer from the second side thereof.

14. The method of claim 10, wherein joining comprises joining the first and second wafers together with an adhesion layer therebetween.

15. The method of claim 10, wherein joining the first and second wafers together is performed prior to forming the plurality of openings.

16. The method of claim 10, wherein forming the plurality of recesses comprises forming the plurality of recesses by at least one of wet etching and reactive ion etching.

* * * * *